United States Patent [19]

Delaney

[11] 4,292,746

[45] Oct. 6, 1981

[54] LIGHT WEIGHT INSULATED ATHLETIC SHOE

[76] Inventor: Glen J. Delaney, 111 Oneida, Apt. 109, Pontiac, Mich. 48053

[21] Appl. No.: 33,129

[22] Filed: Apr. 25, 1979

[51] Int. Cl.[3] ..... A43B 1/14; A43B 5/00; A43C 15/00

[52] U.S. Cl. ..... 36/83; 36/4; 36/45; 36/67 D; 36/134

[58] Field of Search ..... 36/83, 87, 134, 129, 36/4, 114, 59 R, 59 D, 67 D, 45

[56] References Cited

U.S. PATENT DOCUMENTS

| | | | |
|---|---|---|---|
| 1,653,526 | 12/1927 | White | 36/67 D |
| 2,254,685 | 9/1941 | Jackson . | |
| 2,619,741 | 12/1952 | Clark | 36/83 |
| 2,721,811 | 10/1955 | Dacey et al. | 36/45 X |
| 2,724,676 | 11/1955 | Randall et al. | 36/4 X |
| 2,745,197 | 5/1956 | Holt | 36/67 D |
| 2,757,461 | 8/1956 | Cartmell . | |
| 2,803,070 | 8/1957 | Passidomo et al. | 36/67 D |
| 3,050,874 | 8/1962 | Silombra . | |
| 3,552,043 | 1/1971 | Moffa | 36/67 D |
| 3,553,858 | 1/1971 | Austin | 36/134 X |
| 3,589,036 | 6/1971 | Hendricks et al. . | |
| 3,616,552 | 11/1971 | Kniffin . | |
| 3,643,352 | 2/1972 | Adair . | |
| 3,823,493 | 7/1974 | Brehm et al. . | |
| 3,846,921 | 11/1974 | Kobayashi . | |
| 3,882,614 | 5/1975 | Albaladejo | 36/67 D |
| 4,010,558 | 3/1977 | Slusher . | |
| 4,016,661 | 4/1977 | Tibbitts | 36/4 |

FOREIGN PATENT DOCUMENTS

| | | | |
|---|---|---|---|
| 611531 | 3/1935 | Fed. Rep. of Germany | 36/4 |
| 2102023 | 7/1971 | Fed. Rep. of Germany | 36/4 |
| 1299353 | 12/1971 | United Kingdom | 36/4 |

*Primary Examiner*—James Kee Chi

*Attorney, Agent, or Firm*—Basile, Weintraub & Hanlon

[57] ABSTRACT

A light weight insulated athletic shoe is disclosed. The athletic shoe comprises a sole of flexible rubber having a skid resistant tread; an outer layer of semi permeable material which allows the passage of air and excludes the passage of moisture; an intermediate layer of stretchable sponge rubber bonded to the outer layer; and an inner lining of fabric bonded to the intermediate layer. A plurality of metallic inserts are disposed between the sole and the outer layer, the inserts include a threaded aperture to receive a threaded upper end of a removable stud. The studs are employed when the wearer encounters icy surfaces. The inserts are recessed below the surface of the sole so that metallic contact with paved surfaces and the resulting loss in traction will not occur when the studs have been removed. Wrench flats are provided along the projecting portions of the studs for ease of insertion and removal of the studs.

4 Claims, 2 Drawing Figures

LIGHT WEIGHT INSULATED ATHLETIC SHOE

BACKGROUND OF THE INVENTION

The sport of jogging, particularly during inclement weather, is often discouraging to the athletically inclined person because warm shoes which would prevent wet feet and frost bite are generally too heavy and too bulky to make jogging enjoyable. Athletic shoes currently available to the athletically inclined are bulky, heavy, and expensive when a warm moisture resistant shoe is used. The present invention discloses an athletic shoe specifically designed to provide insulation from cold, a barrier to the inclusion of moisture, and is light weight and flexible so that running and jogging can be enjoyed in cold weather as well as year round.

FIELD OF THE INVENTION

The present invention relates to the field of shoes, and more particularly, to the field of light weight athletic shoes with materials designed for insulation against cold. Even more particularly, the present invention relates to light weight shoes that are insulated and include a material which allows the free circulation of air but excludes moisture from entry into the shoe. Even more particularly, the present invention includes an athletic shoe of the type described above which employs selectively insertable studs which give traction on icy surfaces.

DESCRIPTION OF THE PRIOR ART

Inventors have for many years addressed the problem of producing warm and/or comfortable foot wear for athletic use. The prior art footwear generally addresses only one of the desired attributes, namely, either a warm, heavy and bulky shoe or a light weight comfortable shoe for running which is useable only in warm weather. U.S. Pat. Nos. 2,757,461; 3,050,874; 3,589,036; and 3,823,493 disclose footwear of this type. Anti-skid protection has in the past been provided by either studded over shoes or by removable studs which threadingly engage an insert in the sole of the shoe or boot. Disclosures of this type are shown in U.S. Pat. Nos. 2,254,685; 3,616,552; 3,643,352; 3,846,921; and 4,010,558.

None of the above listed U.S. Patents disclose a light weight insulated athletic shoe comprising a sole of flexible rubber having a skid resistant tread; an outer layer of semi-permeable material which allows the passage of air and excludes the passage of moisture; an intermediate layer of stretchable sponge rubber bonded to the outer layer; and an inner layer of fabric bonded to the intermediate layer. Nor do any of the above-listed U.S. Patents disclose a light weight insulated athletic shoe as defined above including a plurality of removable studs which threadingly engage a plurality of threaded inserts recessed below the surface of the sole.

SUMMARY OF THE INVENTION

The present invention comprises a light weight insulated athletic shoe for use in cold weather. The shoe of the present invention comprises a sole of flexible rubber with a skid resistant tread; an outer layer of semi-permeable material which allows the passage of air therethrough but excludes the passage of moisture; an intermediate layer of stretchable sponge rubber bonded to the outer layer; and an inner lining of fabric bonded to the intermediate layer. The outer layer is made from a commercially available material having excellent insulating properties, which is light weight, allows the passage of air into and out of the shoe, and serves as a barrier to the entry of moisture into the shoe. The outer layer is commercially available under the trade name of "GORETEX". The intermediate layer of stretchable sponge rubber bonded to the outer layer has excellent insulating characteristics and a soft texture which conforms to the shape of the foot. The outer layer, intermediate layer, and interlining all completely encircle the foot and extend up the leg to mid calf to provide comfort and warmth to the wearer.

The front portion of the shoe is split from the top to a point midway along the length of the foot for ease of putting the shoe on and taking it off. Eyelets and/or hooks are provided along the length of the opening to accommodate a lace for securing the shoe to the wearer's leg and foot.

The sole of the shoe is made of flexible rubber or a similar synthetic material and has a skid resistant tread. A plurality of metalic inserts are disposed between the sole and the outer layer. The inserts comprise a threaded aperture which is aligned with an aperture through the sole. A plurality of removable studs are engageable with the threaded apertures in the inserts, the studs comprising a threaded upper end to enter the aperture and threadingly engage the threaded aperture, a tapered projecting portion projecting below the sole terminating with a rounded point, and a pair of opposed wrench flats along the projecting portion. The wrench flats serve as a means for inserting or removing the studs from the inserts.

For a more complete understanding of the present invention reference is made to the following detailed description and accompanying drawing.

Other objects, advantages, and applications of the present invention will become apparent to those skilled in the art to which this invention pertains, when the accompanying description of the best modes contemplated for practicing the invention are read in conjunction with the accompanying drawing.

BRIEF DESCRIPTION OF THE DRAWING

In the drawing, like reference numbers refer to like parts throughout the several views, and wherein.

DESCRIPTION OF THE PREFERRED EMBODIMENT

Figure 2:
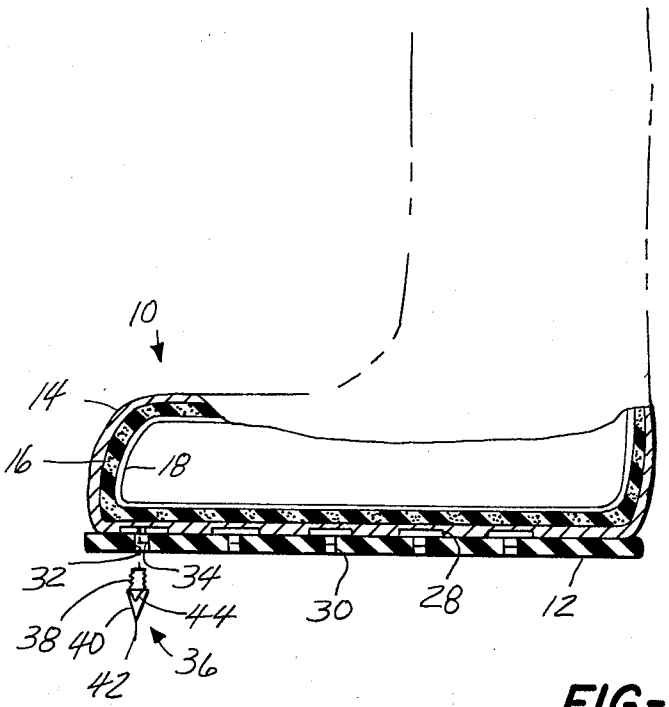
FIG. 2 illustrates a cross sectional view of the shoe of FIG. 1.
Figure 1:
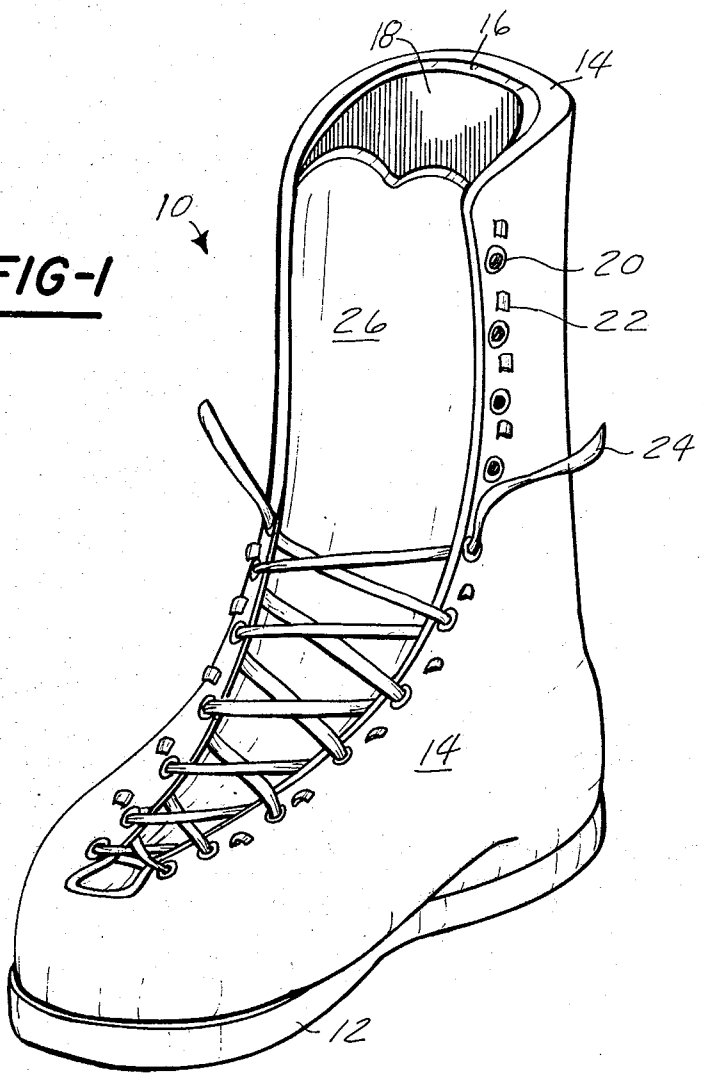
FIG. 1 illustrates a perspective view of the shoe of the present invention.

Referring now to the drawing and in particular to FIGS. 1 and 2 wherein there is illustrated at 10 a preferred embodiment of the present invention. The light weight insulated athletic shoe of the present invention comprises a sole 12 of flexible rubber having a skid resistant tread along a bottom wall thereof. The sole 12 is bonded to an outer layer of semi permeable material which allows the passage of air therethrough but excludes the passage of moisture. The outer layer 14 surrounds the foot of the wearer from the sole of the foot to approximately mid calf providing a snug moisture proof support of the foot and ankle. An intermediate layer 16 of stretchable sponge rubber is bonded to the outer layer 14 surrounding the foot and ankle as described hereinabove. The intermediate layer 16 is covered on the inside of the shoe thereof by a lining of fabric material 18 bonded to the inner surface of the intermediate layer 16. The fabric 18 serves as a friction reducing and comfort improving surface to contact the leg and stocking of the wearer.

To aid in the mounting and removal of the shoe from the wearer's foot, the forward portion of the shoe is slit from the top thereof to a point just short of the toe to allow the shoe to be opened along the slit. A plurality of eyelets 20 and hooks 22 are distributed along the edges of the slit to aid in the closure of the boot once the foot has been properly placed therein. A lace 24 is threaded through the eyelets 20 or engaged along the hooks 22 to close the boot once the wearer's foot has been inserted therein. A tongue 26 made of the semi permeable material which comprises the outer layer extends across the opening created by the slit when the boot is opened to receive the wearer's foot. The tongue 26 is bonded along its edges to the edges of the slit from the lower portion of the slit to a portion proximate the wearer's ankles. The innerlining fabric 18 is bonded to the inner surface of the tongue 26.

A plurality of metallic inserts 28 are disposed between the sole 12 and the outer layer 14 (FIG. 2). The inserts 28 comprise a projection 30 aligned with an aperture 32 through the sole 12. The projection 30 has a threaded aperture 34 extending through the insert 28. A plurality of removable studs 36 have a threaded upper end 38 configured to threadingly engage the threaded aperture 34. The studs 36 have a tapered lower portion 40 projecting below the lower surface of the sole terminating with a rounded point 42. A pair of opposed wrench flats 44 serve as a means for inserting and/or removing the studs from the shoe. The inserts 28 are recessed from the lower surface of the sole 12 so that when the studs 36 have been removed no metal will project below the tread of the boot which might cause loss of traction on hard surfaces such as concrete.

Adequate insulation and water proof protection can be obtained for the shoe using a layer of the outer material "GORE-TEX" which is similar in texture to nylon. A layer of $\frac{1}{8}$ to $\frac{1}{4}$ inch (depending on density) of sponge rubber for the intermediate layer provides adequate insulation and softness for the required comfort. Sponge rubber is mostly air and therefore very light in weight and is a good insulator so the combination of the outer layer of "GORE-TEX" and the intermediate layer of stretchable sponge rubber comprises a shoe skin that is only $\frac{1}{8}$–$\frac{1}{4}$ of an inch thick yet is flexible, stretchable, and an extremely good insulator. The outer layer also provides the wearer with protection against moisture, snow, rain, or slush; yet the material can breathe, providing ventilation for the foot. The removable studs 36 are, in a preferred embodiment, made from metal, preferably steel. However, for conditions where extended wear may be desired, a tungsten carbide tip may be employed. The studs 36 may also be made from a softer material, such as hard rubber or plastic, to produce an abrasion resistant non-scratching stud. In an alternate embodiment, nylon may be used as the outer material.

Having thus described my invention what I claim is:

1. A light weight insulated athletic shoe comprising:

a sole of flexible rubber having a skid resistant tread;

an outer layer of semi-permeable material having a soft texture and insulating properties which allows the passage of air and excludes the passage of moisture allowing the shoe to breath, bonded at a lower portion thereof to said sole;

an intermediate layer of stretchable sponge rubber bonded to the outer layer to provide an insulating layer;

a cloth inner lining bonded to said intermediate layer providing a friction reducing and comfort improving surface to contact the leg and stocking of the wearer;

a front portion of the shoe slit from the top to a point midway along the length of the foot for ease in putting on and removal of the shoe;

a tongue of semi-permeable material extending across the opening created by said slit when the shoe is opened to receive the foot, said tongue bonded along its edges to the edges of said slit;

said inner lining extending across said tongue;

a plurality of eyelets disposed along edges of said slit to receive a lace to close said slit;

a plurality of hooks disposed along said slit between said eyelets to alternately retain said lace to secure the shoe to the wearer's foot;

a plurality of recesses formed in the outer layer at the interface of the sole and outer layer;

a plurality of apertures concentric with said recesses formed through said sole;

a plurality of metallic inserts, each of said inserts disposed between the sole and the outer layer including an enlarged inner head complementary to said recess and a projection;

said projection being complementary to said aperture and including a threaded aperture formed in said projection, with said aperture through the sole being recessed beneath a lower surface of said sole so that no portion of said projection will contact the surface on which the wearer may walk; and a plurality of removable studs engageable with the inserts, said studs comprising a threaded upper end to enter the aperture and threadingly engage the threaded aperture, a tapered projecting lower end projecting below the sole and terminating with a rounded point, and a pair of opposed wrench flats along the projecting portion for insertion and removal of said studs.

2. The light weight insulated athletic shoe as defined in claim 1 further comprising a stud made of metal.

3. The light weight insulated athletic shoe as defined in claim 1 further comprising a stud made from tungsten carbide tipped metal.

4. The light weight insulated athletic shoe as defined in claim 1 further comprising a stud made from abrasion resistant plastic.

* * * * *